US008382525B2

(12) United States Patent
Shiraki

(10) Patent No.: US 8,382,525 B2
(45) Date of Patent: Feb. 26, 2013

(54) DIRECT-CONNECT FUSE UNIT FOR BATTERY TERMINAL

(75) Inventor: Takashi Shiraki, Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 0 days.

(21) Appl. No.: 13/039,809

(22) Filed: Mar. 3, 2011

(65) Prior Publication Data

US 2011/0306243 A1 Dec. 15, 2011

(30) Foreign Application Priority Data

Jun. 15, 2010 (JP) ..... 2010-136531

(51) Int. Cl.
*H01R 13/68* (2006.01)

(52) U.S. Cl. ..... 439/620.26; 439/76.2; 439/500; 439/34

(58) Field of Classification Search ..... 439/620.26, 439/76.2, 500, 34
See application file for complete search history.

(56) References Cited

U.S. PATENT DOCUMENTS

| | | | | |
|---|---|---|---|---|
| 5,389,462 | A * | 2/1995 | Lin | 429/121 |
| 6,512,443 | B1 | 1/2003 | Matsumura et al. | |
| 6,666,722 | B2 | 12/2003 | Fukumori et al. | |
| 6,939,167 | B2 * | 9/2005 | Kosuge | 439/522 |
| 6,948,982 | B2 * | 9/2005 | Higuchi et al. | 439/620.26 |
| 7,046,115 | B2 * | 5/2006 | Higuchi et al. | 337/193 |
| 7,597,595 | B2 * | 10/2009 | Ohashi et al. | 439/766 |
| 2006/0040527 | A1 * | 2/2006 | Shirota | 439/76.2 |
| 2008/0050981 | A1 * | 2/2008 | Pavlovic et al. | 439/701 |

FOREIGN PATENT DOCUMENTS

| | | |
|---|---|---|
| JP | A-06-151001 | 5/1994 |
| JP | A-2000-331591 | 11/2000 |

* cited by examiner

*Primary Examiner* — Gary F. Paumen
(74) *Attorney, Agent, or Firm* — Oliff & Berridge, PLC

(57) ABSTRACT

An object of the present invention is to provide a direct-connect fuse unit for a battery terminal that can restrain from being upsized and can mount various kinds of electrical components. A conducting hardware is integrally provided with a connecting terminal. The connecting terminal is bent in a plate thickness direction of the conductive hardware to project from a surface of a casing. An electrical component housing contains and holds an external electrical component connected to the connecting terminal. The electrical component housing is separated from the casing and is adapted to be fitted in the casing.

9 Claims, 9 Drawing Sheets

DIRECT-CONNECT FUSE UNIT FOR BATTERY TERMINAL

BACKGROUND

1. Technical Field

The exemplary embodiments to a direct-connect fuse unit for a battery terminal and more particularly relates to a fuse unit that is directly connected to a terminal of a battery mounted on a motor vehicle.

2. Background Art

An electrical power terminal of a battery for a motor vehicle (hereinafter, referred to a battery terminal) is connected through a direct-connect fuse unit for the battery terminal to an output side electrical cable. An electrical power from the battery is supplied through an electrical junction box (a relay box, a fuse box, a junction box, or the like) connected to the output side electrical cable to various kinds of loads. If an excessive current flows in the electrical junction box, a fusing section of the fuse unit is fused to cut off the excessive current to the output side electrical cable, thereby protecting the various kinds of loads connected to the output side electrical cable at a downstream side. Such direct-connect fuse unit for the battery terminal has been disclosed in, for example, JP 2000-331591 A.

In a direct-connect fuse unit for a battery terminal, a conducting hardware is formed by pressing and punching a metallic sheet so that the conductive hardware is integrally provided with an input side terminal section to be connected to the battery terminal, an output side terminal section to be connected to the output side electrical cable, and a fusing section for interconnecting the input and output side terminal sections. A casing is molded of synthetic resin to be integrated with the conducting hardware. The casing serves to partially cover front and rear sides of the flat plate-like conducting hardware except the terminal sections and fusing section.

However, because the conducting hardware spreads in a flat plate-like manner in the conventional direct-connect fuse unit for the battery terminal, a footprint of the fuse unit around the battery terminal is likely to increase. If a plurality of output side terminal sections and fusing sections are provided on the conducting hardware, the fuse unit itself increases in size. Consequently, the fuse unit cannot be arranged in a limited space around the battery terminal.

Furthermore, because the casing is molded integrally with the conducting hardware, the output side terminal section is limited to a simple structure in which a stud bolt is provided on an exposed conducting hardware. Also, there is a problem that the electrical components that can be attached to the direct-connect fuse unit for the battery terminal will be subject to constraints.

SUMMARY

In view of the above problems, an object of the present invention is to provide a direct-connect fuse unit for a battery terminal that can be prevented from increasing in size and can mount various kinds of electrical components.

A first aspect of the present invention is directed to a direct-connect fuse unit for a battery terminal and for use with an external electrical cable, including a flat plate-like conducting hardware including front and reverse sides and being integrally provided with an input side terminal section for connection with the battery terminal, an output side terminal section for connection to the external electrical cable, and a fusing section for interconnecting the input and output side terminal sections; and a casing molded of synthetic resin that partially covers the front and reverse sides of the conducting hardware; the conducting hardware being integrally provided with a connecting terminal, said connecting terminal being bent in a plate thickness direction of the conducting hardware to project from a surface of the casing; and an electrical component housing adapted to contain the connecting terminal so that the external electrical component connected to the connecting terminal is held in the housing, the housing being formed separately from the casing and adapted to be fitted in the casing.

According to a direct-connect fuse unit for a battery terminal in the first aspect of the present invention, since the connecting terminal integrally provided on the conducting hardware is bent in the plate thickness direction of the conducting hardware to project from the surface of the casing, it is possible to provide a mounting space for the external electrical components such as fuses and connectors in the direct-connect fuse unit for the battery terminal by utilizing upper and lower area in a narrow empty space in the casing surface. It is also possible to mount the various kinds of electrical components such as fuses and connectors on the direct-connect fuse unit for the battery terminal by changing a shape of the electrical component housing.

In addition, since the electrical component housing is separated from the casing, it is possible to provide the electrical component housing in the fuse unit while avoiding to upsize the direct-connect fuse unit for the battery terminal.

A second aspect of the present invention is directed to the direct-connect fuse unit for a battery terminal according to the first aspect. In the direct-connect fuse unit in the second aspect, the casing includes a corner portion formed with two orthogonal side walls; and a rectangular housing mounting recess that is open in the surface of the casing inside the corner portion, the two orthogonal side walls each having an orthogonal wall surface, and each of the two orthogonal side walls is provided with an engaging portion; and the electrical component housing is formed into a substantially rectangle tubular configuration, the electrical component housing is provided on each of the two orthogonal wall surfaces to be mounted on the two orthogonal side walls of the housing mounting recess with an engaging projection that is elastically deformable inward, the engaging projection of the electrical component housing is engaged with the engaging portion of the casing so that the electrical component housing is detachably engaged with the housing mounting recess, and other two orthogonal wall surfaces of the electrical component housing are fitted on other two orthogonal side walls of the housing mounting recess.

According to the direct-connect fuse unit for the battery terminal in the second aspect of the present invention, it is possible to strongly fit the electrical component housing in the casing by utilizing the space at the corner of the direct-connect fuse unit for the battery terminal. Since the engaging reaction exerted in the one orthogonal side wall can be supported on the other orthogonal side wall, it is possible to stably maintain a mounting condition of the electrical component housing.

A third aspect of the present invention is directed to the direct-connect fuse unit for the battery terminal according to the second aspect. In the direct-connect fuse unit for the battery terminal in the third aspect, each of the two orthogonal side walls includes a projecting end surface, the housing mounting recess is provided on each of the two orthogonal side walls with an engaging cut-out portion that is open in the projecting end surface of each of the two orthogonal side walls, the engaging projection provided on the two orthogonal wall surfaces of the electrical component housing is inserted into said engaging cut-out portion, and the electrical component housing is positioned in the housing mounting recess.

According to the direct-connect fuse unit for the battery terminal in the third aspect of the present invention, when the electrical component housing is mounted on the casing, the engaging projection is guided and pushed into the engaging cut-out portion, and the electrical component housing is positioned in the casing. Accordingly, it is possible to stably position the electrical component housing in the casing at the initial stage of mounting the electrical component housing on the housing mounting recess, thereby avoiding breakage of the engaging projection on account of misalignment of the engaging projection at the initial stage and enhancing an assembling work.

In addition, since the housing mounting recess is provided on its side wall with the engaging cut-out portion, it is possible to downsize the positioning mechanism including the electrical component housing and the housing mounting recess while restraining the projecting length of the engaging projection of the electrical component housing from increasing downward.

According to the present invention, since the connecting terminal is bent in the plate thickness direction of the conducting hardware and the electrical component housing that contains the connecting terminal is separated from the casing, it is possible to provide the electrical component housing on the direct-connect fuse unit for a battery terminal while avoiding to upsize the fuse unit.

DETAILED DESCRIPTION OF EMBODIMENTS

Figure 1:
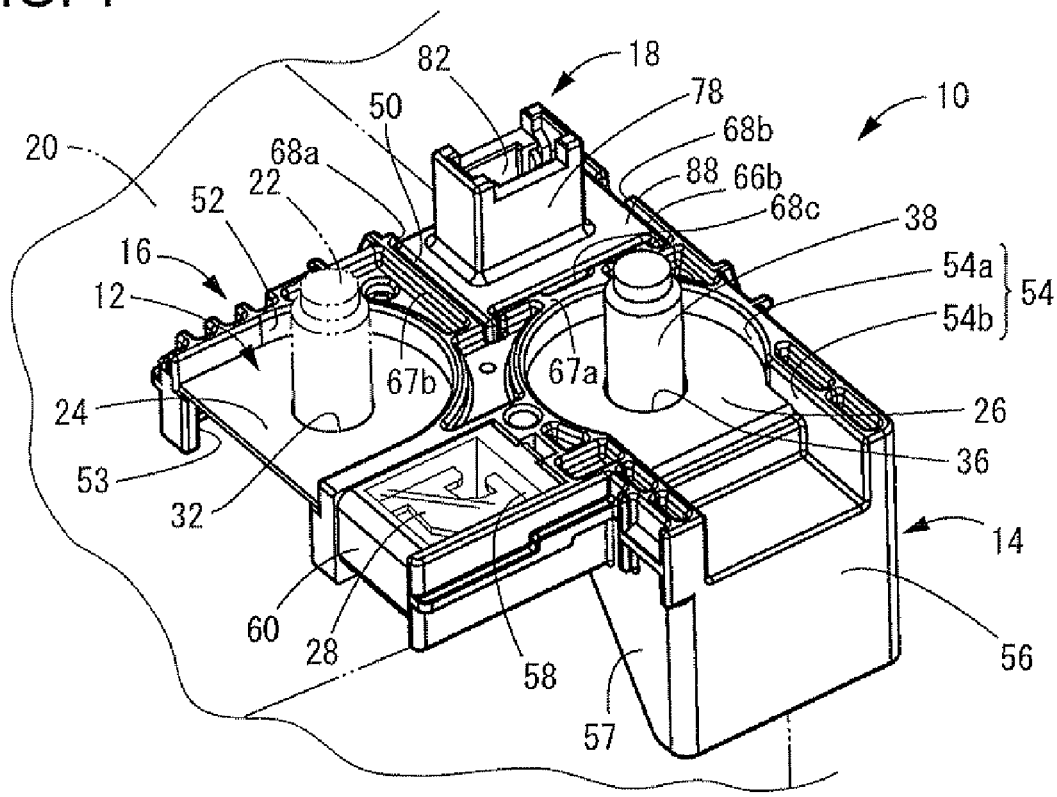
FIG. 1 is a perspective view of a first embodiment of a direct-connect fuse unit for a battery terminal in accordance with the present invention, illustrating the fuse unit mounted on a battery.

Referring now to the drawings, embodiments of a direct-connect fuse unit for a battery terminal will be described below.

Figure 2:
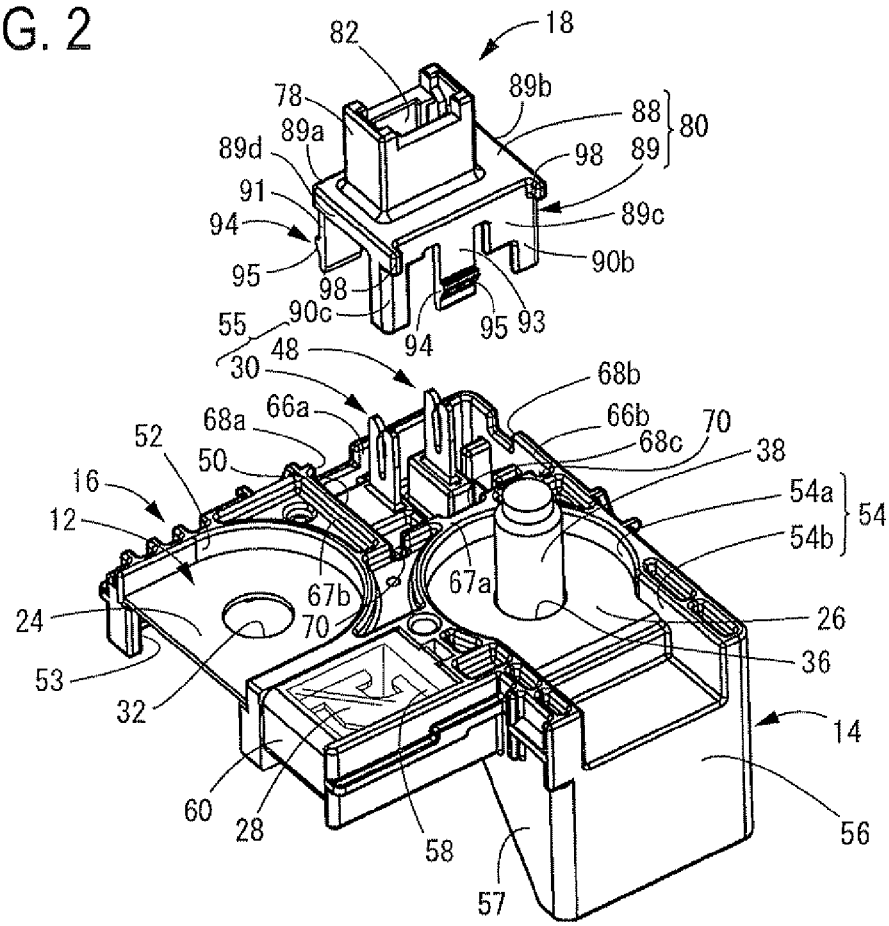
FIG. 2 is an exploded perspective view of the direct-connect fuse unit for the battery terminal shown in FIG. 1.

FIG. 1 shows a perspective view of a first embodiment of a direct-connect fuse unit 10 for a battery terminal. FIG. 2 shows an exploded perspective view of the direct-connect fuse unit 10 for the battery terminal in order to explain an assembled state. The fuse unit 10 may include a conducting hardware 12 and a casing 14 for covering front and rear sides of the fuse unit 10. A fuse housing (an electrical component housing) 18 that may be formed into a discrete member may be fitted and mounted on a top surface of a unit main body 16 comprising the conducting hardware 12 and casing 14. The use unit 10 constructed above may be mounted on a battery 20 for a motor vehicle shown by imaginary lines 20 in FIG. 1 to be connected to a battery terminal 22. Hereinafter, for convenience of explanations, upper and lower directions in FIGS. 1 and 2 designate upper and lower directions so long as there is no special explanation.

Figure 3:
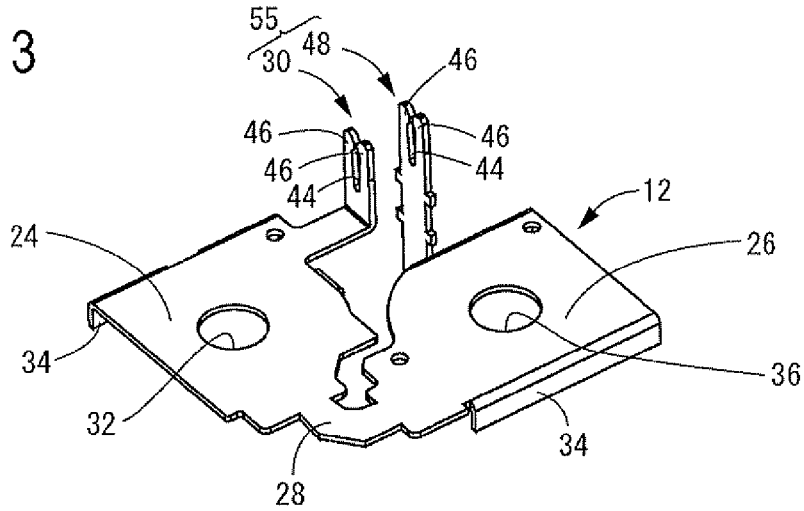
FIG. 3 is a perspective view of a conducting hardware and a downstream side fuse connecting terminal that constitute the direct-connect fuse unit for the battery terminal shown in FIG. 1.
Figure 4:
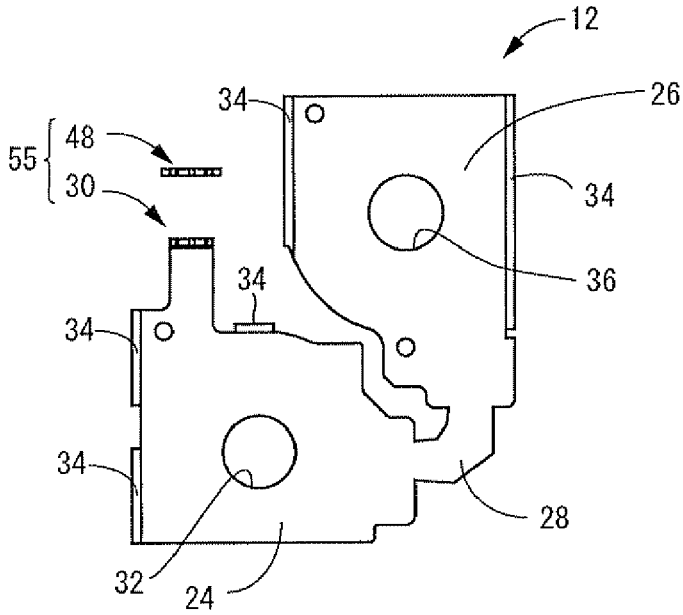
FIG. 4 is a plan view of the direct-connect fuse unit for the battery terminal shown in FIG. 3.

FIGS. 3 and 4 show the conducting hardware 12. The conducting hardware 12 may be formed into a substantially flat plate-like configuration. The conducting hardware 12 may be produced by pressing and bending a metallic sheet. The conducting hardware 12 may have a size in thickness enough to conduct a great capacity current from the battery 20. The conducting hardware 12 includes an input side terminal section 24, an output side terminal section 26, and a fusing section 28 that interconnects the input and output side terminal portions 24 and 26. The conducting hardware 12 may be integrally provided with an upstream side fuse connecting terminal (a connecting terminal) 30. The conducting hardware 12 may be disposed on the battery 20 to spread on a horizontal plane when the fuse unit 10 is mounted on the battery 20.

Specifically, the conducting hardware 12 may be formed into a substantially square shape in a plan view in FIG. 4. The input side terminal section 24 may be provided on one corner of the square shape (a left lower corner in FIG. 4) while the output side terminal section 26 may be provided on a diagonal corner (a right upper corner in FIG. 4). The input and output side terminal sections 24 and 26 may be interconnected by the fusing section 28 provided on a right lower corner in FIG. 4.

The input side terminal section 24 of the conducting hardware 12 may be formed into a substantially square shape in a plan view in FIG. 4. The input side terminal section 24 may be provided in its central part with a circular battery terminal inserting aperture 32. A battery terminal 22 may be inserted into the aperture 32 to be connected to the conducting hardware 12. The input side terminal section 24 may be provided its left side edge and an upper side edge of on an outer periphery in FIG. 4 with two bent portions 34 and a single bent portion 34 that are bent downward and extend with the same lengths. These bent portions 34 enhance bending strength of the conducting hardware 12. Since cut portions of the conducting hardware 12 may be bent downward by the bent portions 34, it is possible to reduce a possibility that a working person may be injured by burrs on an end surface of the metallic plate when the person holds the conductive hardware 12.

On the other hand, the output side terminal section 26 may be formed into a substantially square shape in a plan view in FIG. 4, as may be the case with the input side terminal section 24. The output side terminal section 26 may be provided in its central part with a circular stud bolt inserting aperture 36. A stud bolt 38 shown in FIGS. 1 and 2 may be inserted into the aperture 36 to be connected to an end of an external electrical cable (not shown). The stud bolt 38 may be provided with a thread (not shown) on a part projecting from the output side terminal section 26. Furthermore, the output side terminal section 26 may be provided on its whole right and left outer peripheral edges with bent portions 34 that are bent downward and extend with the same lengths as those of the bent portions 34 of the input side terminal section 24. A left lower corner of the output side terminal section 26 may be formed into an arc shape in order to avoid interference with the input side terminal section 24.

The input and output side terminal sections 24 and 26 may be interconnected by the fusing section 28. The fusing section 28 may be disposed on a right lower corner of the conducting hardware 12 in FIG. 4 and may be formed into an L-shaped configuration that extends to the input and output side terminal sections 24 and 26 in the left and right sides in FIG. 4 and has a sufficiently small size in width. The fusing section 28 may be connected at both narrow ends to the input and output side terminal sections 24 and 26. A metallic block (not shown) having a low melting point may be attached to the fusing section 28.

Thus, if an excessive current flows between the input and output side terminal sections 24 and 26, the metallic block having the low melting point is molten to form an alloy of the metallic block and fusing section having a large resistance, thereby generating heat. This heat will melt the fusing section 28. A size in width of the fusing section 28 may be determined suitably in accordance with an allowable amount of current, as may be the case with a publicly known direct-connect fuse unit for a battery terminal.

Furthermore, the conductive hardware 12 may be integrally provided on an upper end of the input side terminal section 24 in FIG. 4 with an upstream side fuse connecting terminal 30. The upstream side fuse connecting terminal 30 extends by a given size in width from the input side terminal section 24. The upstream side fuse connecting terminal 30 may extend upward by a given length from the input side terminal section 24 in FIG. 4 and is bent toward a direction perpendicular to the paper in FIG. 4 (an upward direction in FIG. 3). The upstream side fuse connecting terminal 30 may be bent in its plate thickness direction after the conductive hardware 12 is punched out by pressing.

The upstream side fuse connecting terminal 30 may be provided on its projecting end with a so-called tuning fork-like terminal. The upstream side fuse connecting terminal 30 may be provided in its central part in a width direction with a groove that extends by a given depth from a distal end so that the groove does not reach the bent portion. This groove defines a tab terminal inserting portion 44. A distal end of both sides of the tab terminal inserting portion 44 defines an insulation displacement terminal 46. As mentioned later, when an external electrical component (not shown), such as another fuse, is inserted into the tab terminal inserting portion 44, the insulation displacement terminal 46 is connected to a tab terminal of the other fuse and they are electrically coupled to each other.

A downstream side fuse connecting terminal 48 may be provided on a position opposed to the upstream side fuse connecting terminal 30 of the conducting hardware 12 to be separated from the conducting hardware 12. The downstream side fuse connecting terminal 48 may be formed into a flat belt-like metallic plate having the same width as that of the upstream side fuse connecting terminal 30. The downstream side fuse connecting terminal 48 may be produced by pressing a metallic plate, as is the case with the conducting hardware 12.

One side of the downstream side fuse connecting terminal 48 may be arranged to oppose an outer surface of the upstream side fuse connecting terminal 30 of the conducting hardware 12. The downstream side fuse connecting terminal 48 may be provided on its projecting end with a tuning fork-like terminal, as is the case with the upstream side fuse connecting terminal 30. The downstream side fuse connecting terminal 48 may include a tab terminal inserting portion 44 and an insulation displacement terminal 46. The downstream side fuse connecting terminal 48 may be provided on its intermediate part in a longitudinal direction with two positioning projections that protrude from right and left sides in a width direction of the downstream side fuse connecting terminal 48.

The conducting hardware 12 and downstream side fuse connecting terminal 48 may be partially covered by and contained in the casing 14. The conducting hardware 12, the downstream side fuse connecting terminal 48, and the casing 14 constitute a unit main body 16 shown in FIGS. 5 to 7.

The casing 14 that constitutes the unit main body 16 may be formed into a substantially block-like configuration that covers the conducting hardware 12 at upper and lower sides (front and rear sides). The unit main body 16 including the conducting hardware 12 and casing 14 may be formed into a substantially square shape in a plan view in FIG. 5, as a whole. The casing 14 may be made of synthetic resin. The conducting hardware 12 and downstream side fuse connecting terminal 48 are integrally molded in the casing 14 as an insert product. Upon molding the casing 14 in the first embodiment, the downstream side fuse connecting terminal 48 together with the conducting hardware 12 may be formed into an insert product. However, upon molding the casing 14, only the conducting hardware 12 may be formed into an insert product and the downstream side fuse connecting terminal 48 may be attached to the casing 14 after molding the casing 14. When insert-molding the casing 14, the stud bolt 38 is previously inserted into the stud bolt inserting aperture 36 in the output side terminal section 26.

Figure 5:
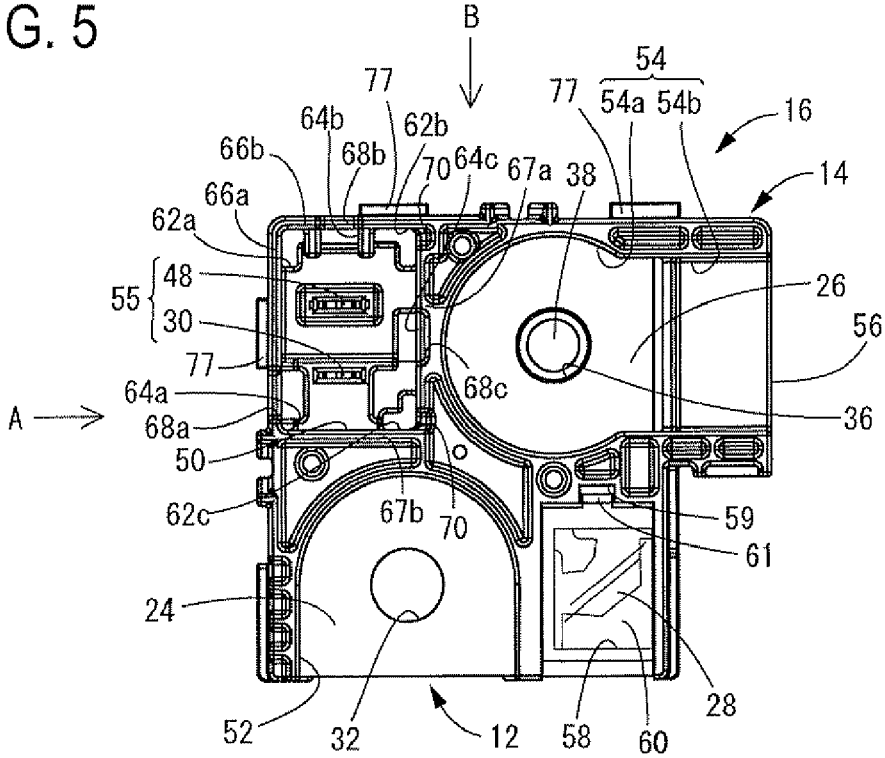
FIG. 5 is a plan view of a unit main body that constitutes the direct-connect fuse unit for the battery terminal shown in FIG. 1.

Thus, as shown in FIG. 5, in the molded unit main body 16 including the conducting hardware 12, downstream side fuse connecting terminal 48, and casing 14 that covers them, the input side terminal section 24, fusing section 28, and downstream side fuse connecting terminal 48 may be exposed outward at a left lower side, a right lower side, and a right upper side of the casing 14. The casing 14 may be provided on its left upper side with a fuse housing mounting recess (a housing mounting recess) 50. Distal ends of the upstream side fuse connecting terminal 30 and downstream side fuse connecting terminal 48 project upward (upward in FIG. 6) from a bottom wall of the fuse housing mounting recess 50. Thus, the pair of upstream and downstream side fuse connecting terminal 30 and 48 cooperate to define a fuse mounting section 55.

The input side terminal section 24 of the casing 14 may be provided on its periphery except its lower part in FIG. 5 with an upper side peripheral wall 52 and a lower side peripheral wall 53 that protrude upward and downward. An area surrounding the lower side peripheral wall 53 contains a support hardware (not shown) for supporting the battery terminal 22. An area surrounding the upper side peripheral wall 52 may contain a nut (not shown) to be screwed on the battery terminal 22.

Figure 6:
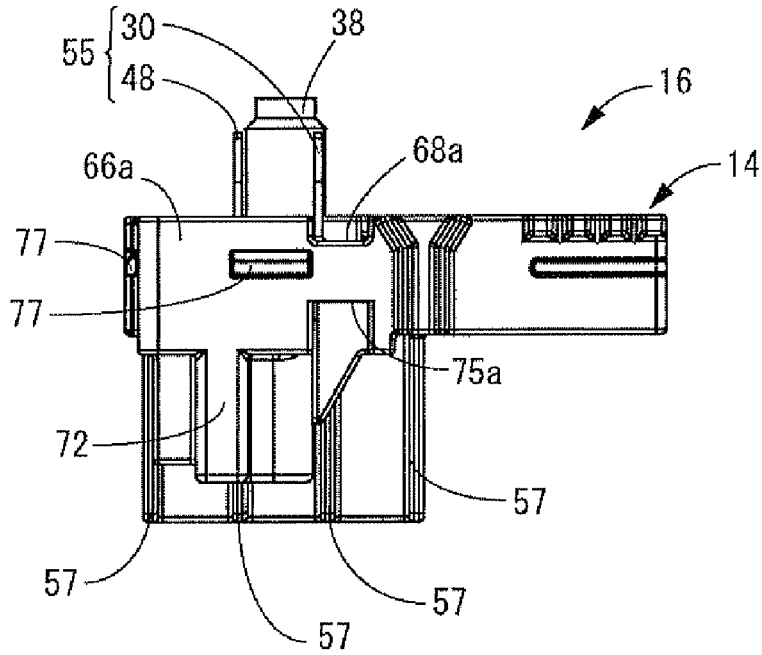
FIG. 6 is a side elevation view of the unit main body taken by an arrow A in FIG. 5.

On the other hand, the output side terminal section 26 of the casing 14 may be provided on its periphery with an external electrical cable containing wall 54 that may be open at a left side of the output side terminal section 26 in FIG. 5 and may protrude upward (upward in FIG. 6). The external electrical cable containing wall 54 may surround the output side terminal section 26 to contain a crimp terminal (not shown) attached to an end of an external electrical cable. That is, the external electrical cable containing wall 54 may include an arc portion 54*a* surrounding the stud bolt 38, and straight portions 54*b* extending straightly from opposite ends of the arc portion 54*a* to the open side. A bolt fixing portion of the crimp terminal (not shown) may be contained inside the arc portion 54*a*. A flat plate-like extension extending from the bolt fixing portion of the crimp terminal may be contained inside the straight portions 54*b*.

The external electrical cable containing wall 54 may be connected to a vertical wall 56 protruding outward to a lower part of the casing 14 at an open side end between the straight portions 54*b*. The external electrical cable attached to an end of the crimp terminal (not shown) may be led along the vertical wall 56 to the lower side of the casing 14. In order to secure strength for supporting the external electrical cable (not shown), the vertical wall 56 may be connected to a bottom wall of the casing 14 through triangular ribs 57 that are spaced apart from one another in a width direction.

Furthermore, the casing 14 may be provided on its right lower side in FIG. 5, in which the fusing section 28 is exposed, with a fusing section containing aperture 58 that has a rectangular shape in cross section and penetrates the casing 14 downward. The fusing section 28 may be disposed on a substantially central part in a depth direction of the fusing section containing aperture 58. The fusing section 28 may be exposed outward from ports of the fusing section containing aperture 58 at the upper and lower surfaces of the casing 14. Furthermore, a transparent protecting cover 60 made of synthetic resin covers each of the ports of the fusing section containing aperture 58 at the upper and lower surfaces of the casing 14.

The protecting cover 60 may be formed by bending a belt-like member with a given width into a U-shaped configuration. When the protecting cover 60 may be fitted in the fusing section containing aperture 58 in the casing 14 from a side wall (a lower side wall in FIG. 5), the upper and lower ports of the fusing section containing aperture 58 are covered by the protecting cover 60. Thus, the fusing section 28 disposed in the fusing section containing aperture 58 can be seen through the protecting cover 60. The protecting cover 60 can prevent the fusing section from contacting with the external electrical components. Furthermore, it is possible to prevent broken pieces caused upon fusing the fusing section 28 from being scattered outward. The protecting cover 60 may be integrally provided on its extending ends with engaging projections 61. When the engaging projections 61 are locked on engaging recesses 59 in open peripheral edges around the fusing section containing aperture 58, the protecting cover 60 may be detachably fixed on the casing 14.

The fuse housing mounting recess 50 spreads in a rectangular shape around the upstream and downstream side fuse connecting terminals 30 and 48. The fuse housing mounting recess 50 may be open in a surface (an upper surface in FIG. 2) of the casing 14 inside an inner periphery of a first corner defined by a pair of orthogonal side walls 66*a* and 66*b* of the casing 14. Thus, the two orthogonal side walls 66*a* and 66*b* constitute the first corner of the fuse housing mounting recess 50. A pair of orthogonal side walls 67*a* and 67*b* that projects upward from a bottom wall of the fuse housing mounting recess 50 may constitute a second corner of the recess 50. The side wall 67*a* may be opposed to and may extend in parallel to the side wall 66*a* while the side wall 67*b* may be opposed to and may extend in parallel to the side wall 66*b*.

Furthermore, the bottom wall of the fuse housing mounting recess 50 may be provided with positioning leg receiving apertures 62*a*, 62*b*, and 62*c* that penetrate the bottom wall on the first corner at which the side walls 66*a* and 66*b* intersect, on a third corner at which the side wall 66*b* and side wall 67*a* intersect, and on the second corner at which the side walls 67*a* and 67*b* intersect. Positioning legs 90*a*, 90*b*, and 90*c* (mentioned later) may be provided on the fuse housing 18 are inserted into the positioning leg receiving apertures 62*a*, 62*b*, and 62*c*. The positioning leg receiving apertures 62*a*, 62*b*, and 62*c* may be formed into L-shaped cross sections in association with the positioning legs 90*a*, 90*b*, and 90*c*.

The fuse housing mounting recess 50 may be provided on an outer peripheral edge of the bottom wall with engaging lance receiving apertures 64*a*, 64*b*, and 64*c* that are disposed inside the side walls 66*a*, 66*b*, and 67*a* and penetrate the bottom wall. First, second, and third engaging lances 91, 92, and 93 (mentioned later) provided on the fuse housing 18 may be inserted into the lance receiving apertures 64*a*, 64*b*, and 64*c*. The lance receiving apertures 64*a*, 64*b*, and 64*c* may be formed into given cross sections that can receive the engaging lances 91, 92, and 93.

The side walls 66*a*, 66*b*, and 67*a* are provided on their projecting end surfaces (upper surfaces in FIG. 2) with engaging cut-out portions 68*a*, 68*b*, and 68*c* that may be disposed at positions corresponding to the lance receiving apertures 64*a*, 64*b*, and 64*c* inside the side walls 66*a*, 66*b*, 67*a* and are open in projecting surfaces. The engaging cut-out portions 68*a*, 68*b*, and 68*c* have the same sizes in width as those of the lance receiving apertures 64*a*, 64*b*, and 64*c*. The side wall 67*a* may be provided on its opposite ends (upper and lower ends in FIG. 5) in a longitudinal direction with positioning recesses 70 that are open in the projecting end surfaces. The positioning projections 98 (mentioned later) provided on the fuse housing 18 may be fitted in the positioning recesses 70.

Figure 7:
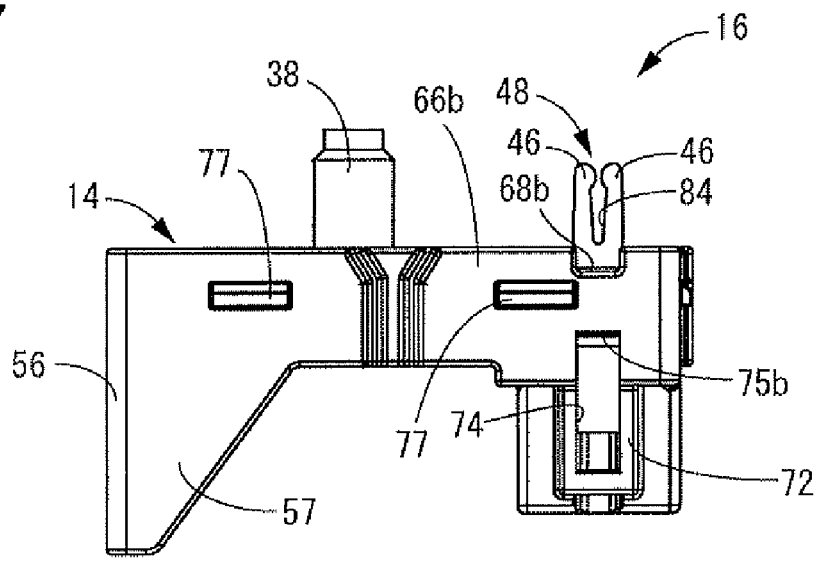
FIG. 7 is a side elevation view of the unit main body taken by an arrow B in FIG. 5.

On the other hand, the casing 14 is provided with a connector connecting portion 72 on a rear side of the fuse housing mounting recess 50, that is, on a lower side of the fuse housing mounting recess 50 in FIGS. 6 and 7. The connector connecting portion 72 may be formed into a tubular configuration that extends from the lower side of the casing 14. A lower end of the downstream side fuse connecting terminal 48 may be exposed in the connector connecting portion 72. As shown in FIG. 7, the connector connecting portion 72 may be provided on its outer peripheral wall surface with a rectangular engaging window 74 that may be open at an outer peripheral side to lock an engaging projection of a connector (not shown).

The engaging window 74 may be disposed in an upper and lower direction in FIG. 7 above the engaging cut-out portion 68*b* provided on the projecting end of the side wall 66*b*. An opening end of the engaging window 74 at an upper side of the casing 14 may be open in the engaging lance receiving aperture 64*b* inside the side wall 66*b* and may be communicated with the engaging lance receiving aperture 64*b*. Thus, the upper side opening end of the engaging window 74 defines an engaging portion 75*b* (FIG. 7) that is open in the engaging lance receiving aperture 64*b*. On the other hand, as shown in FIG. 6, the side wall 66*a* may be provided with an engaging portion 75*a* that is disposed below the engaging cut-out portion 68*a* and may be formed by cutting out a lower end part of the side wall 66*a* in a recess-like shape. The engaging portion 75*a* may be open in and is communicated with the engaging lance receiving aperture 64*a*. The casing 14 may be provided on its side surface with a plurality of cover locking projections 77 for securing a battery terminal cover (not shown) to the casing 14.

Figure 8:
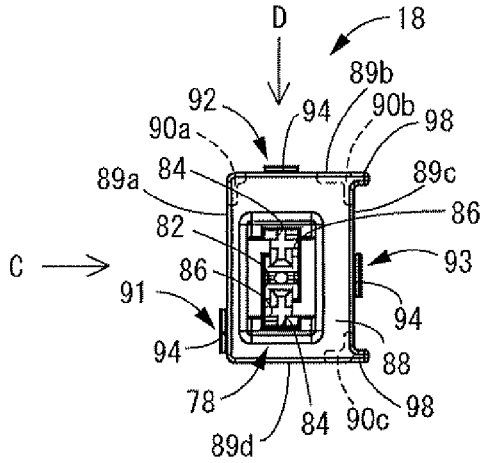
FIG. 8 is a plan view of a fuse housing that constitutes the direct-connect fuse unit for the battery terminal shown in FIG. 1.
Figure 9:
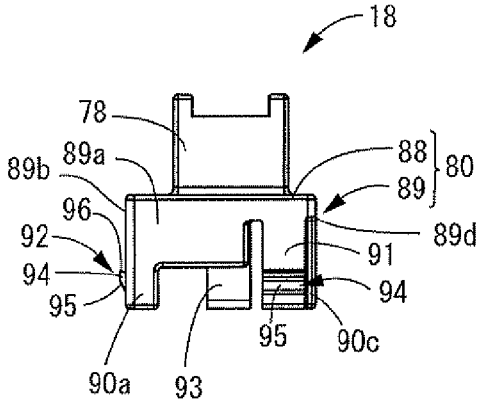
FIG. 9 is a side elevation view of the fuse housing taken by an arrow C in FIG. 8.
Figure 10:
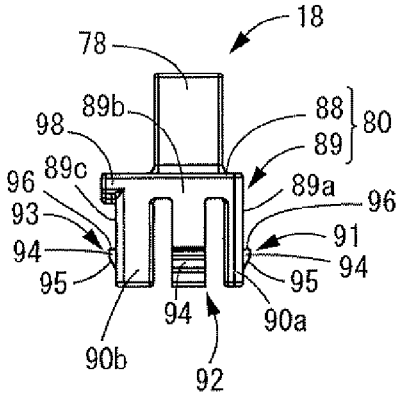
FIG. 10 is a side elevation view of the fuse housing taken by an arrow D in FIG. 8.
Figure 11:
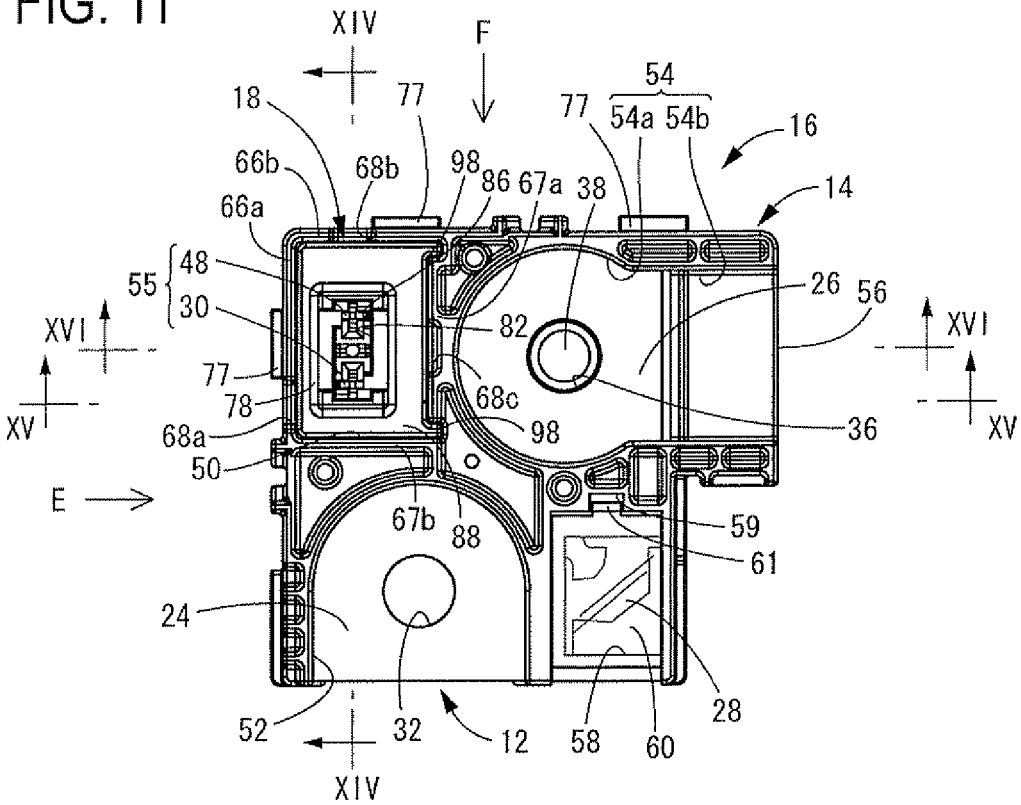
FIG. 11 is a plan view of the direct-connect fuse unit for the battery terminal shown in FIG. 1.
Figure 12:
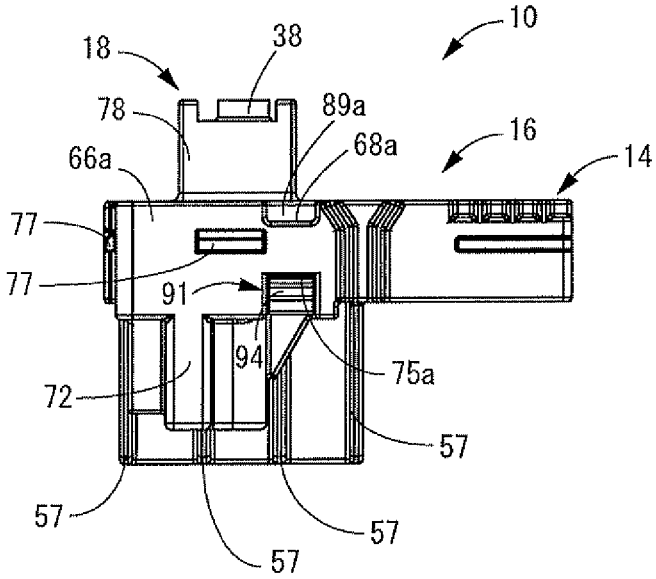
FIG. 12 is a side elevation view of the direct-connect fuse unit for the battery terminal taken by an arrow E in FIG. 11.
Figure 13:
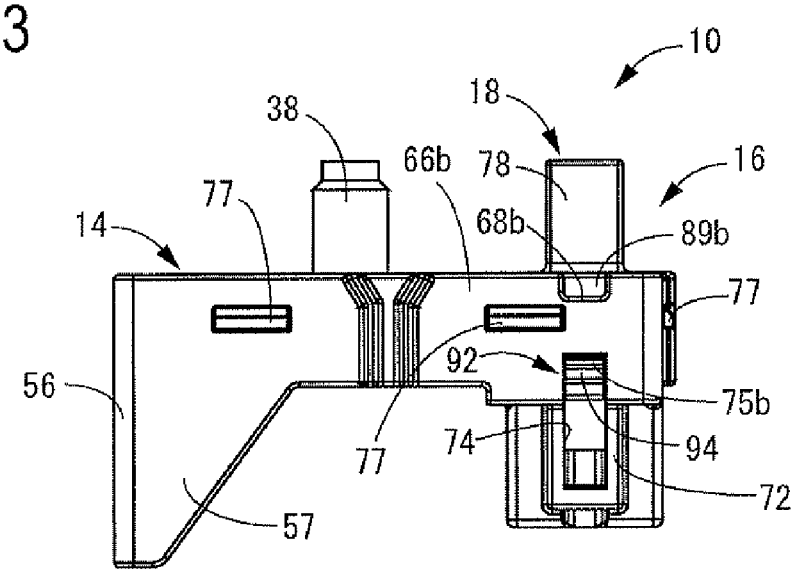
FIG. 13 is a side elevation view of the direct-connect fuse unit for the battery terminal taken by an arrow F in FIG. 11.

FIGS. 8 to 10 show the fuse housing 18 to be attached to the fuse mounting section 55. The fuse housing 18 may be a discrete member from the casing 14 and may be made of synthetic resin. As shown in FIG. 9, the fuse housing 18 may include a fuse holding section 78 that projects upward, and an attaching leg section 80 may be provided on a lower side of the fuse holding section 78.

The fuse holding section 78 of the fuse housing 18 may be formed into a tubular configuration having a rectangular cross section and an upward opening, as is the case with a publicly known blade type fuse mounting section. Specifically, the fuse holding section 78 may be provided in its interior with a containing recess 82 for containing an external electrical component (not shown) such as a fuse. The containing recess 82 may have a rectangular cross section. The containing recess 82 may be provided in its inner wall at a short side with a tab containing groove 84 for containing and holding a tab terminal of a fuse (not shown). On the other hand, the containing recess 82 may be provided on its bottom with a pair of fuse connecting terminal receiving apertures 86 into which the upstream and downstream side fuse connecting terminals 30 and 48 are inserted. Thus, when the fuse housing 18 may be mounted on the unit main body 16, the upstream and downstream side fuse connecting terminals 30 and 48 project from the bottom of the containing recess 82 to be contained in the recess 82. Furthermore, while using the fuse unit 10, fuses (not shown) may be mounted on the fuse mounting section 55 including the upstream and downstream side fuse connecting terminals 30 and 48 to be contained and held in the containing recess 82.

On the other hand, an attaching leg section 80 of the fuse housing 18 may include a rectangular flange-like flat plate 88 that is larger than the fuse holding section 78, and a tubular portion 89 having a small thickness and a rectangular cross section. The tubular portion 89 may include side surfaces 89*a*, 89*b*, 89*c*, and 89*d* that are fitted in the side walls 66*a*, 66*b*, 67*a*, and 67*b* of the fuse housing mounting recess 50, respectively.

As shown in FIGS. 8 to 10, the rectangle tubular portion 89 may be provided on a first corner at which the side surfaces 89*a* and 89*b* intersect each other, on a second corner at which the side surfaces 89*b* and 89*c* intersect each other, and on a third corner at which the side surfaces 89*c* and 89*d* intersect each other with positioning leg portions 90*a*, 90*b*, and 90*c* that have substantially L-shaped cross sections and extend downward straightly.

The rectangle tubular portion 89 may be provided on its side surfaces 89*a*, 89*b*, and 89*c* with first, second, third engaging lances 91, 92, and 93 that have the substantially same sizes in width and extend downward, respectively. That is, proximal ends of the first, second, third engaging lances 91, 92, and 93 may be connected to the side surfaces 89*a*, 89*b*, and 89*c* to form cantilever type configurations and project downward with the substantially same sizes in length, respectively. Thus, the projecting ends of the first, second, third engaging lances 91, 92, and 93 can be elastically deformed to an inner periphery of the rectangle tubular portion 89.

The rectangle tubular portion 89 may be integrally provided on its side surface 89*c* with positioning projections 98, 98 (FIG. 8) that protrude outward. The positioning projections 98, 98 may have profiles that can be fitted in the positioning recesses 70, 70 in the side wall 67*a* of the fuse housing mounting recess 50 in the casing 14. When the positioning projections 98, 98 on the particular side surface 89*c* of the fuse housing 18 are fitted in the positioning recesses 70, 70 in the casing 14, it is possible to prevent the fuse housing 18 from being assembled on the fuse housing mounting recess 50 in an incorrect direction.

Thus, as shown in FIG. 2, when the fuse housing 18 is disposed on the fuse housing mounting recess 50 in the casing 14 from an upper side of the unit main body 16, the fuse unit 10 is completed. FIGS. 11 to 16 show the fuse unit 10 in which the fuse housing 18 is attached to the unit main body 16. When the fuse housing 18 is attached to the unit main body 16, the upstream and downstream side fuse connecting terminals 30 and 48 provided on the unit main body 16 are accommodated in the containing recess 82 in the fuse housing 18 to define the fuse mounting section 55 in the fuse housing 18.

When the fuse housing 18 is attached to the fuse housing mounting recess 50, the attaching leg section 80 is contained in the fuse housing mounting recess 50. Three positioning legs 90*a*, 90*b*, and 90*c* of the fuse housing 18 may be contained in the positioning leg receiving apertures 62*a*, 62*b*, and 62*c* in the fuse housing mounting recess 50. The first, second, and third engaging lances 91, 92, and 93 of the fuse housing 18 may be contained in the engaging lance receiving apertures 64*a*, 64*b*, and 64*c* in the fuse housing mounting recess 50.

When the fuse housing 18 is attached to the fuse housing mounting recess 50, the first, second, and third engaging lances 91, 92, and 93 may engage the casing 14, thereby preventing the fuse housing 18 from being disconnected from the casing 14. Since the first, second, and third engaging lances 91, 92, and 93 may have the same structures, respectively, an engaging mechanism of the fuse housing 18 will be explained by exemplifying the second engaging lance 92 by referring to FIG. 14.

Figure 14:
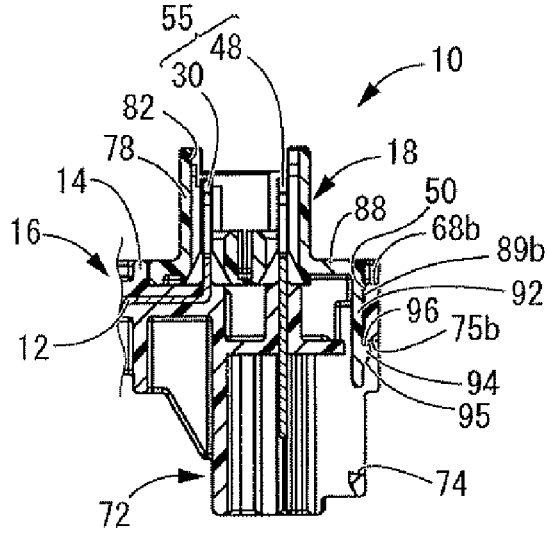
FIG. 14 is a cross section view of the direct-connect fuse unit for the battery terminal taken along lines XIV-XIV in FIG. 11.

At the initial stage of mounting the fuse housing 18 on the fuse housing mounting recess 50, the distal ends of the positioning leg portions 90*a* and 90*b* and the second engaging lance 92 may be inserted into the open ends of the fuse housing mounting recess 50 (that is, inside the side wall 66*b*). At this time, an engaging projection 94 on a distal end of the second engaging lance 92 may be pushed into and positioned in the engaging cut-out portion 68*b* in the side wall 66*b*. Then, as the fuse housing 18 is being pushed down, a slant surface 95 of the engaging projection 94 on the second engaging lance 92 contacts with a bottom surface of the engaging cut-out portion 68*b*. Next, the second engaging lance 92 is guided along the slant surface 95 and is deflected inward. When the fuse housing 18 is further pushed down, the engaging projection 94 reaches the engaging window 74. At this time, as shown in FIG. 14, the second engaging lance 92 is released from the inward deflection and an engaging flat surface 96 of the engaging projection 94 is engaged with the engaging portion 75*b* of the engaging window 74 formed by utilizing the opening in the upper side of the casing 14.

Figure 15:
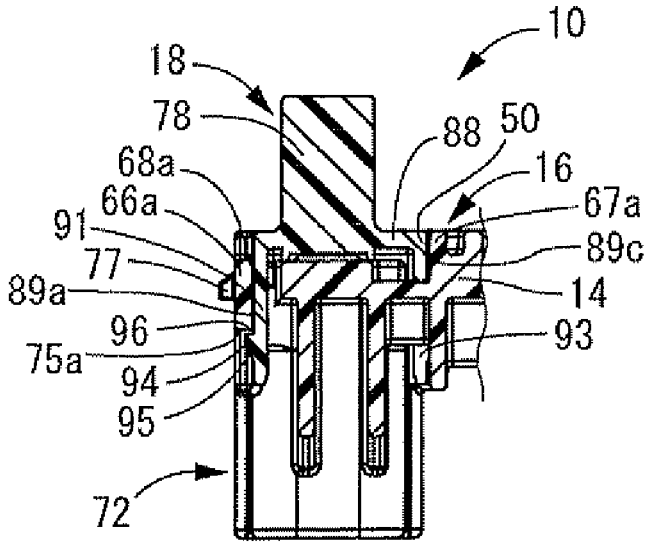
FIG. 15 is a cross section view of the direct-connect fuse unit for the battery terminal taken along lines XV-XV in FIG. 11.
Figure 16:
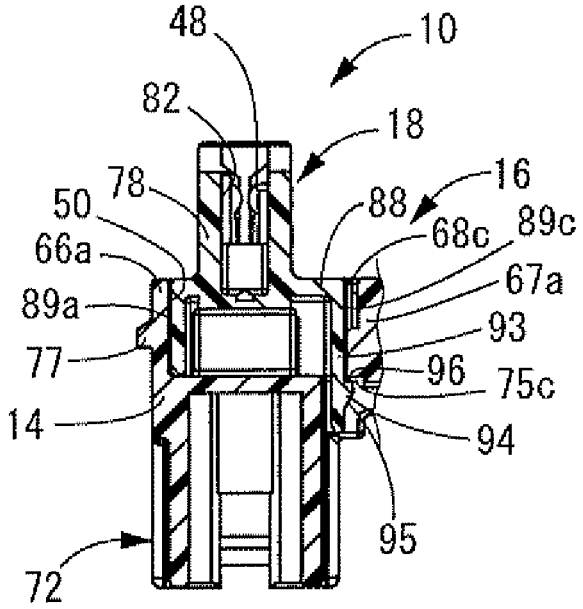
FIG. 16 is a cross section view of the direct-connect fuse unit taken for the battery terminal along lines XVI-XVI in FIG. 11.

FIGS. 15 and 16 show the first and third engaging lances 91 and 93 under engaged states. When the first and third engaging lances 91 and 93 are inserted into the connector connecting portion 72, the projecting portion of the engaging projections 94 are inserted into the engaging cut-out portions 68*a* and 68*c* in the wall surface of the fuse housing mounting recess 50. Then, the first and third engaging lances 91 and 93 are deflected inward. When the first and third engaging lances 91 and 93 are further pushed down and the engaging projections 94 reach the engaging portions 75*a* and 75*c*, the first and third engaging lances 91 and 93 return to the original positions by their resilience and the engaging projections 94 are fitted in the engaging portions 75*a* and 75*c*. Such an engaging action of the engaging projections 94 of the first, second, and third engaging lances 91, 92, and 93 enable the fuse housing 18 to detachably engage the fuse housing mounting recess 50.

Thus, in the fuse housing 18, the engaging projections 94 of the first, second, and third engaging lances 91, 92, and 93 are inserted into the engaging cut-out portions 68*a*, 68*b*, and 68*c*, the fuse housing 18 is correctly positioned in the fuse housing mounting recess 50, and the engaging portions 94 of the first, second, and third engaging lances 91, 92, and 93 are deflected by the pushing action. Since the positioning action of the fuse housing 18 and the deflecting action of the first, second, and third engaging lances 91, 92, and 93 are carried out in sequence, it is possible to avoid the flexible first, second, and third engaging lances 91, 92, and 93 from being broken on account of misalignment upon insertion and to enhance an assembling work.

Regarding engagement of the second engaging lance 92, an upper end surface of the engaging window 74 in the side wall 66*b* can be utilized as the engaging portion 75*b* that engages the engaging projection 94, thereby decreasing the number of parts and saving a space. Furthermore, the attaching leg section 80 of the fuse housing 18 may include the rectangle tubular portion 89. When the fuse housing 18 is inserted into the fuse housing mounting recess 50, the side surfaces 89*a* and 89*b* that constitute the one of the orthogonal wall surfaces of the rectangle tubular portion 89 on which the first and second engaging lances 91 and 92 are superimposed on the side walls 66*a* and 66*b* that constitute the one of the orthogonal walls of the fuse housing mounting recess 50. The side surfaces 89*c* and 89*d* that may constitute the other orthogonal wall surface of the rectangle tubular portion 89 are superimposed on the side walls 67*a* and 67*b* that may constitute the other orthogonal wall of the fuse housing mounting recess 50. Thus, the attaching leg section 80 of the fuse housing 18, the side walls 66*a* and 66*b* of the fuse housing mounting recess 50, and the orthogonal side walls 67*a* and 67*b* may reinforce one another. Furthermore, an engaging reaction force against the engaging portions 75*a* and 75*b* of the first and second engaging lances 91 and 92 on the side surfaces 89*a* and 89*b* that are the one orthogonal side walls can be supported by a contact force against the orthogonal walls 67*a* and 67*b* of the fuse housing mounting recess 50 of the side surfaces 89*c* and 89*d* that are the other orthogonal walls. Accordingly, the fuse housing 18 may be stably held in the fuse housing mounting recess 50. In addition, since the positioning projections 98, 98 provided on the fuse housing 18 are fitted in the positioning recesses 70, 70 in the fuse housing mounting recess 50, the fuse housing 18 may be positioned and held in the fuse housing mounting recess 50 more stably.

Thus, the fuse housing 18 is assembled to the unit main body 16 to define the fuse unit 10. The fuse housing 18 may be mounted on a left upper corner of the fuse unit 10 in FIG. 1. The upstream and downstream side fuse connecting terminals 30 and 48 are contained in the fuse housing 18 to oppose each other, thereby defining the fuse mounting section 55.

As shown in FIG. 1, the fuse unit 10 constructed above may be mounted on an upper surface of the motor vehicle battery 20. The input terminal 22 of the motor vehicle battery 20 may be inserted into a battery terminal inserting aperture 32 of the input side terminal section 24 and a nut may be screwed onto the input terminal 22 to secure the input terminal 22 to the input side terminal section 24. Thus, an electrical power from the battery 20 may be supplied to the input side terminal section 24. On the other hand, a crimp terminal attached to an end of an external electrical cable (not shown) may be attached to the stud bolt 38 provided on the output side terminal section 26 and a nut may be screwed onto the stud bolt 38 to secure the external electrical cable to the stud bolt 38 by a nut. Thus, the electrical power from the battery 20 to the input side terminal section 24 may be supplied through the fusing section 28 of the fuse unit 10 to the external electrical cable. An electrical junction box such as a relay box, a fuse box, or a junction box may be connected to the external electrical cable. An electrical power may be supplied through the electrical junction box to various kinds of loads in the motor vehicle. If an excessive current from the battery 20 flows in the electrical junction box on account of any causes, the fusing section 28 in the fuse unit 10 may be fused to prevent the excessive current from flowing in the output side electrical cable, thereby protecting the various kinds of loads connected to downstream components.

On the other hand, a publicly known blade type fuse (not shown) having any rated current may be mounted on a fuse mounting section 55 provided on the fuse unit 10. As well known, the fuse includes a pair of tab terminals, and a fusing portion disposed between the tab terminals. On the other hand, the fuse mounting section 55 includes the upstream side fuse connecting terminal 30 that has a pair of insulation displacement portions 46 formed into a tuning fork-like configuration, and the downstream side fuse connecting terminal 48. Accordingly, when the tab terminals are inserted into the insulation displacement portions and the fuse is mounted on the fuse mounting section 55, the upstream and downstream side fuse connecting terminals 30 and 48 are electrically conducted through the fusing section to each other. Thus, since the discrete fuse is mounted in the fuse mounting section 55 in the fuse unit 10, it is possible to mount a fuse having any rated current on the fuse unit 10. Thus, the electrical power from the battery 20 may be supplied through the fusing section of the fuse to the downstream side fuse connecting terminal 48.

A connector (not shown) provided on an end of an external electrical cable for a relatively small current may be connected to the connector connecting portion 72 provided below the fuse mounting section 55. The external electrical cable for a relatively small current may be connected to an electrical equipment such as a voltage sensor provided around the battery 20. The electrical power from the battery 20 may be supplied through the discrete fuse mounted on the fuse mounting section 55 to the small current electrical equipment. If an excessive current from the battery 20 flows in the fuse unit 10, the fusing section of the discrete fuse is fused to cut off the excessive current, thereby protecting the electrical equipment or the like connected to the connector.

Thus, in the fuse unit 10 in the first embodiment, because the upstream side fuse connecting terminal 30 provided integrally on the conducing hardware 12 is bent in a plate thickness direction of the conducting hardware 12 to project on the surface of the casing 14, it is possible to effectively utilize a narrow space in the upper and lower direction even on the surface of the fuse unit 10 that is required for an economical space, thereby disposing the fuse mounting section 55 for mounting a discrete fuse on a small space.

In addition, because the fuse housing 18 that contains the fuse may be separated from the casing 14, it is possible to attach the fuse housing 18 to the fuse unit 10 in a compact manner while avoiding to upsize the fuse unit 10.

Because the fuse housing 18 may be discrete from the casing 14, it is possible to provide the fuse housing having a complicated structure on the battery direct-connect fuse unit 10. Accordingly, it is possible to attach a discrete fuse having any rated current to the fuse unit 10 and to directly supply the electrical power from the fuse unit 10 through the discrete fuse to the small current electrical equipment. Consequently, a discrete fuse having a rated current less than, for example, 20 A (twenty amperes) can be mounted on the fuse unit 10 and the small current electrical equipment can be directly connected to the battery direct-connect fuse unit 10.

Because the fuse unit 10 may provide the fuse mounting section 55 on the small current fusing section that has been difficult in punching out the conventional conducting hardware and the discrete fuse may be mounted on the fuse mounting section 55, it is possible to realize to provide the fuse mounting section 55 on the fuse unit 10 for the first time. Thus, it is possible to provide a fusing section having any small current capacity in the fuse unit 10 without limiting a punching width of the conducting hardware 12.

Because the discrete fuse can be attached to the fuse unit 10, it is possible to optionally attach a discrete fuse having various rated currents to the fuse unit 10. Thus, it is possible to directly connect various kinds of electrical equipments to the fuse unit 10 merely by changing a fuse to be mounted on the fuse mounting section 55 in accordance with an allowable current capacity of the electrical equipment to be connected to the fuse unit 10. This will enhance general versatility of the fuse unit 10.

In addition, even if the fusing section of the fuse is fused on account of the excessive current, it is possible to deal with such accident by exchanging the melted fuse for a new discrete fuse without exchanging the whole of the fuse unit 10 or the conducting hardware 12 for a new one. Accordingly, it is possible to greatly save time, effort, and cost for repair.

The attaching leg section 80 of the fuse housing 18 may include the rectangle tubular portion 89 in the fuse unit 10. An engaging reaction force against the engaging portions 75*a* and 75*b* of the first and second engaging lances 91 and 92 on the side surfaces 89*a* and 89*b* that are the one orthogonal side walls can be supported by a contact force against the orthogonal walls 67*a* and 67*b* of the fuse housing mounting recess 50 of the side surfaces 89*c* and 89*d* that are the other orthogonal walls. Accordingly, while utilizing the orthogonal side walls at the corner in a limited empty space at a corner of the casing 14, it is possible to mount a discrete fuse housing 18 on the unit main body 16 with high efficiency in space and stability in holding force.

Furthermore, the engaging cut-out portions 68*a*, 68*b*, and 68*c* are provided on the side walls 66*a*, 66*b*, and 67*a* of the fuse housing mounting recess 50, respectively. Thus, when the fuse housing 18 is mounted on the casing 14, the engaging portions 94 provided near the distal ends of the first, second, and third engaging lances 91, 92, and 93 are pushed into the engaging cut-out portions 68*a*, 68*b*, and 68*c*, and the fuse housing 18 is positioned in a horizontal direction. Under such positioning condition, the first, second, and third engaging lances 91, 92, and 93 can be elastically deformed inward in a stable manner as the fuse housing 18 is being pushed down. That is, since the first, second, and third engaging lances 91, 92, and 93 are flexible and are not strong enough, if the fuse housing 18 is forcedly mounted on the casing 14 with the lances being misaligned, there is a possibility that the first, second, and third engaging lances 91, 92, and 93 may be broken. On the other hand, according to the present embodiment, because it is possible to easily position the first, second, and third engaging lances 91, 92, and 93 at the initial stage of mounting the fuse housing 18 on the casing 14 to elastically deform the lances stably, it is possible to lower a possibility that the first, second, and third engaging lances 91, 92, and 93 may be broken and to easily mount the fuse housing 18 on the casing 14.

In addition, since the engaging cut-out portions 68*a*, 68*b*, and 68*c* are provided on the side walls 66*a*, 66*b*, and 67*a* of the fuse housing mounting recess 50, it is possible to downsize the positioning mechanism including the fuse housing 18 and fuse housing mounting recess 50 without increasing a projecting length of the fuse housing 18 to the first, second, and third engaging lances 91, 92, and 93. Accordingly, it is possible to prevent the fuse housing 18 from being upsized and to enhance workability upon mounting the fuse housing 18 on the casing 14.

Figure 17:
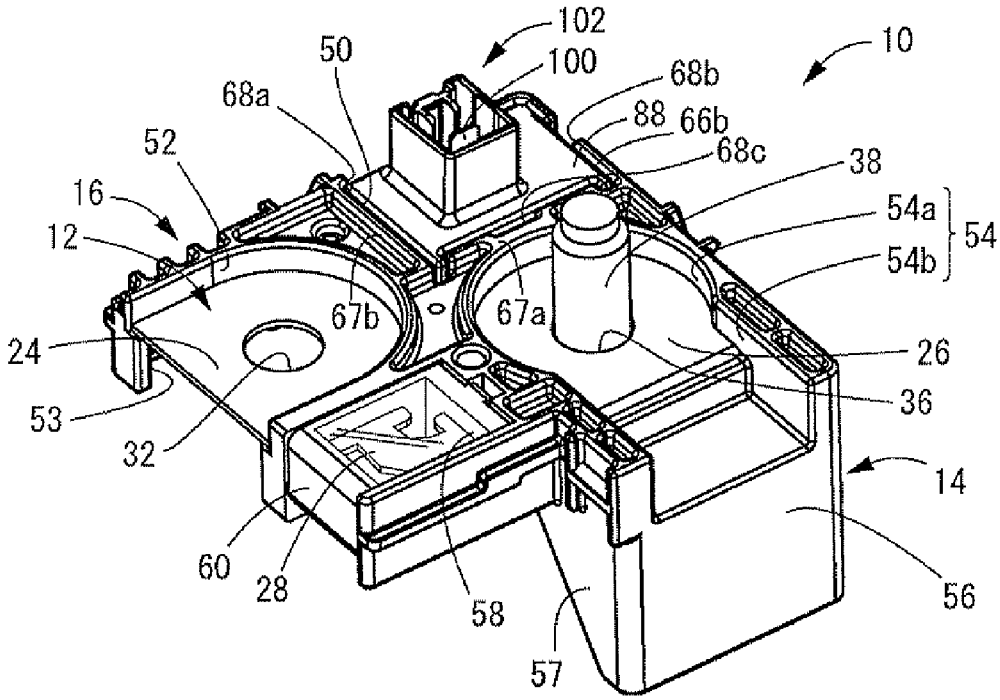
FIG. 17 is a perspective view of a second embodiment of the direct-connect fuse unit for a battery terminal in accordance with the present invention.

Although the embodiment of the present invention is described above in detail, it should be noted that the present invention is not limited to the above embodiment. For example, although the fuse housing 18 is separated from the casing 14 as an electrical component housing in the above embodiment, any electrical component housing may be adopted in accordance with an electrical component to be mounted. For example, as shown in FIG. 17, a single tab terminal 100 may project from the conducting hardware 12 to form a connector connecting portion 102 on which a connector (not shown) is mounted as an external electrical component. In a second embodiment of the direct-connect fuse unit for the battery terminal in accordance with the present invention shown in FIG. 17, detailed explanations are omitted by giving the same signs in the first embodiment to members and positions in the second embodiment. The tab terminal 100 may extend from the output side terminal section 26 and may be disposed at a downstream side beyond the fusing section 28 of the conducting hardware 12. Thus, it is possible to mount various kinds of external electrical components on the direct-connect fuse unit 10 for the battery terminal by optionally changing shapes of the electrical component housing or the connecting terminals.

Positions and numbers of providing the fuse mounting section 55 and connector connecting portion 102 may be changed in accordance with the numbers or the like of the electrical components to be connected. A plurality of fuse mounting sections 55 and connector connecting portions 102 may be provided on the fuse unit 10. A combination of the fuse mounting sections 55 and connector connecting portions 102 may be provided. Particularly, since the upstream side fuse connecting terminal 30 and tab terminal 100 are bent in the plate thickness direction of the conducting hardware 12 to project upward in the fuse unit 10, a plurality of fuse mounting sections 55 and connector connecting portions 102 can be provided more advantageously in a space saving manner.

Furthermore, although the upstream and downstream side fuse connecting terminals 30 and 48 that constitute the fuse mounting section 55 are formed into the tuning fork-like configurations in the above embodiment, they may be formed into a pair of tab-like terminals.

Although the first, second, and third engaging lances 91, 92, and 93 provided with the respective engaging projections 94 may be provided on three positions on the fuse housing 18 and three engaging cut-out portions 68*a*, 68*b*, and 68*c* may be provided on the opening end of the fuse housing mounting recess 50 in the above embodiment, positions and numbers of providing the engaging lances and engaging cut-out portions are not limited. That is, only two first and second engaging lances 91 and 92 may be provided on the fuse housing 18, and only two engaging cut-out portions 68*a* and 68*b* may be provided on the side walls 66*a* and 66*b* of the fuse housing mounting recess 50. The engaging lance may be provided on each of the side surfaces 89*a*, 89*b*, 89*c*, and 89*d* of the fuse housing 18, and the engaging cut-out portion may be provided on each of the side walls 66*a*, 66*b*, 67*a*, and 67*b* of the fuse housing mounting recess 50.

What is claimed is:

1. A direct-connect fuse unit for a battery terminal and for use with an external electrical cable, comprising:

a flat plate-like conducting hardware including front and reverse sides and being integrally provided with an input side terminal section for connection with the battery terminal, an output side terminal section for connection to the external electrical cable, and a fusing section for interconnecting the input and output side terminal sections; and a casing molded of synthetic resin that partially covers the front and reverse sides of the conducting hardware; the conducting hardware being integrally provided with a connecting terminal, said connecting terminal being bent in a plate thickness direction of the conducting hardware to project from a surface of the casing; and an electrical component housing adapted to contain the connecting terminal so that the external electrical component connected to the connecting terminal is held in the housing, the housing being formed separately from the casing and adapted to be fitted in the casing.

2. The direct-connect fuse unit according to claim 1, wherein the casing includes a corner portion formed with two orthogonal side walls; and a rectangular housing mounting recess that is open in the surface of the casing inside the corner portion, the two orthogonal side walls each having an orthogonal wall surface, and each of the two orthogonal side walls is provided with an engaging portion; and wherein the electrical component housing is formed into a substantially rectangle tubular configuration, the electrical component housing is provided on each of the two orthogonal wall surfaces to be mounted on the two orthogonal side walls of the housing mounting recess with an engaging projection that is elastically deformable inward, the engaging projection of the electrical component housing is engaged with the engaging portion of the casing so that the electrical component housing is detachably engaged with the housing mounting recess, and other two orthogonal wall surfaces of the electrical component housing are fitted on other two orthogonal side walls of the housing mounting recess.

3. The direct-connect fuse unit according to claim 2, wherein each of the two orthogonal side walls includes a projecting end surface, the housing mounting recess is provided on each of the two orthogonal side walls with an engaging cut-out portion that is open in the projecting end surface of each of the two orthogonal side walls, the engaging projection provided on the two orthogonal wall surfaces of the electrical component housing is inserted into said engaging cut-out portion, and the electrical component housing is positioned in the housing mounting recess.

4. The direct-connect fuse unit according to claim 3, wherein the engaging cut-out portion has a bottom surface, and the engaging projection includes a slant surface that contacts the bottom surface of the engaging cut-out portion.

5. The direct-connect fuse unit according to claim 4, wherein a plurality of lances are provided on corresponding orthogonal wall surfaces, the lances have substantially the same width.

6. The direct-connect fuse unit according to claim 5, wherein the plurality of lances have proximal ends, the proximal ends of the lances are connectable to the orthogonal wall surfaces to form cantilever type configurations.

7. The direct-connect fuse unit according to claim 6, wherein at least one of the lances has a distal end with the engaging projection disposed at the distal end of the at least one of the lances.

8. The direct-connect fuse unit according to claim 1, wherein the conducting hardware includes an input side terminal section and an output side terminal section, the input side terminal section being separate from the output side terminal section, and the input side terminal section and the output side terminal section being connected via a substantially L-shaped fusing section.

9. The direct-connect fuse unit according to claim 1, wherein the connecting terminal includes a first terminal and a second terminal, and only the first terminal is connected to the conducting hardware.

* * * * *